US008889331B2

(12) United States Patent
Qiu et al.

(10) Patent No.: US 8,889,331 B2
(45) **Date of Patent: *Nov. 18, 2014**

(54) ACOUSTIC METHOD TO PREPARE POLYESTER RESIN EMULSIONS

(71) Applicant: Xerox Corporation, Norwalk, CT (US)

(72) Inventors: Shigang Qiu, Toronto (CA); Santiago Faucher, Oakville (CA)

(73) Assignee: Xerox Corporation, Norwalk, CT (US)

( * ) Notice: Subject to any disclaimer, the term of this patent is extended or adjusted under 35 U.S.C. 154(b) by 22 days.

This patent is subject to a terminal disclaimer.

(21) Appl. No.: 13/782,816

(22) Filed: Mar. 1, 2013

(65) Prior Publication Data

US 2014/0248559 A1 Sep. 4, 2014

(51) Int. Cl.
*G03G 9/083* (2006.01)
*G03G 9/08* (2006.01)

(52) U.S. Cl.
CPC ..... *G03G 9/0804* (2013.01)
USPC ..... 430/137.14; 430/137.1

(58) Field of Classification Search
CPC .... G03G 9/0802; G03G 9/0804; G03G 9/081
USPC ..... 430/137.14, 137.1
See application file for complete search history.

(56) References Cited

U.S. PATENT DOCUMENTS 8,124,309 B2 * 2/2012 Lai et al. ..... 430/137.18
8,435,714 B2 * 5/2013 Lai et al. ..... 430/137.1

* cited by examiner

*Primary Examiner* — Mark A Chapman
(74) *Attorney, Agent, or Firm* — MDIP LLC

(57) ABSTRACT

The disclosure relates to a process for making a latex emulsion suitable for use in a toner comprising at least one amorphous polyester resin and a solvent to form a resin mixture, including that the process is carried out at room temperature using acoustic mixing.

20 Claims, No Drawings

ACOUSTIC METHOD TO PREPARE POLYESTER RESIN EMULSIONS

FIELD

The present disclosure relates to processes for producing latex resin emulsions useful in producing toners. More specifically, more efficient solvent-based processes are provided for emulsifying amorphous polyester resins using acoustic mixing.

BACKGROUND

Numerous processes are within the purview of those skilled in the art for the preparation of toners. Emulsion aggregation (EA) is one such method involving formation of a polymer emulsion by heating a monomer and undertaking a batch or semi-continuous emulsion polymerization, as disclosed in, for example, U.S. Pat. No. 5,853,943, the disclosure of which is hereby incorporated by reference in entirety. Other examples of emulsion/aggregation processes for the preparation of toners are illustrated in U.S. Pat. Nos. 5,902,710; 5,910,387; 5,916,725; 5,919,595; 5,925,488, 5,977,210 and 5,994,020; and U.S. Pub. No. 2008/0107989, the disclosure of each of which hereby is incorporated by reference in entirety.

Polyester toners have been prepared utilizing amorphous and crystalline polyester resins as illustrated, for example, in U.S. Pub. No. 2008/0153027, the disclosure of which is hereby incorporated by reference in entirety. Incorporation of those polyesters into toner requires formulation into emulsions prepared by solvent containing batch processes, for example, solvent flash emulsification and/or solvent-based phase inversion emulsification (PIE), both of which are time and energy-consuming.

Solvent-less latex emulsions have been formed in either a batch or extrusion process through the addition of a neutralizing solution, a surfactant solution and water to a thermally softened resin as illustrated, for example, in U.S. Pub. Nos. 2009/0208864 and 2009/0246680, the disclosure of each of which hereby is incorporated by reference in entirety. However, certain amorphous resins may be difficult to process without solvent because the resin does not have a sharp melting point and exhibits substantial viscosity, which may work against the formation of emulsions. In addition, certain amorphous resins are more susceptible to molecular weight degradation in a solvent-free process.

Typically polyester resin emulsions (latexes) for EA Ultra Low Melt (ULM) toners are obtained batch-wise in a stirred reaction vessel using PIE. Amorphous polyester resin is dissolved in a combination of two organic solvents, such as, methyl ethyl ketone (MEK) and isopropyl alcohol (IPA) at elevated temperature to produce a homogenous organic mixture. A fixed amount of base solution (such as, ammonium hydroxide) is then added to neutralize acid end groups on the polyester chain followed by addition of de-ionized water (DIW) to form a uniform dispersion of polyester particle in water through phase inversion. Total process time generally exceeds 5 hours (including the ramp-up time).

Thus, there is a need for a shorter process cycle.

SUMMARY

The instant disclosure describes a process for making a latex emulsion suitable for use in a toner composition comprising at least one amorphous polyester resin and an organic solvent to form a resin mixture, including that the process can be carried out at room temperature using acoustic mixing technology. The process provides smaller latex particles which may be useful, for example, in better dispersion of pigment particles at high pigment loadings.

In embodiments, a process is disclosed including combining an amorphous resin, a solvent, an optional base and water to form a mixture; subjecting the mixture to acoustic mixing at a frequency of from about 3 Hertz to about 300 Hertz at room temperature; and forming a uniform emulsion. The process can be completed in less than 30 minutes; the final particle size of the latex resin can be less than about 120 nm; and the particles can be in low melt toner or hyperpigmented toner.

DETAILED DESCRIPTION

ULM EA toners typically contain two types of amorphous resins (high molecular weight and low molecular weight amorphous resins). The amorphous resins account for about 75 wt % of the toner composition. A formulation of about a 10/5/1 ratio of resin/MEK/IPA for amorphous low molecular weight resin, of about a 10/6.5/1.5 ratio for amorphous high molecular weight resin, and about a 40° C. temperature process for both have been used for making latexes with a particle size of about 180 nm to about 230 nm, which may be used to make ULM toner particles which have a toner particle size from about 5 to about 7 um.

In embodiments, a Resodyn resonance acoustic mixer (RAM), which applies low frequency, high intensity acoustic energy, and consistent shear field throughout an entire vessel within minutes, is utilized in the process as disclosed. High efficiency mixing and homogenization is achieved without pipes, pumps, and impellers. The PIE latexes processed in the acoustic mixer have similar or smaller particle size as compared to emulsions prepared with a stirred reactor. Moreover, the process is completed in minutes and at room temperature as compared to hours at elevated temperatures with the existing technology, resulting in lower benchmark latex cost.

The results obtained at the lab scale with the Resodyn (Butte, Mont.) acoustic mixer are scalable. According to the manufacturer, the process time to disperse 500 g in a LabRAM (Resodyn, 1 lb. capacity) is the same as the time required to disperse 220 kg in the RAM55 (Resodyn, 920 lb. capacity) at the same acceleration (g). In comparison, the PIE process implemented in a stirred reaction vessel requires at least five hours. There is also potential to implement a continuous process for the production of latex thus permitting even higher production batches.

In embodiments, a method for making an amorphous resin latex is disclosed including combining an amorphous resin, a solvent, an optional base and water to form a mixture, and acoustically mixing the mixture to form an emulsion at room temperature, wherein said process is completed in minutes rather than hours.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating." and, "matching," or grammatic variations thereof, have generally acceptable definitions or at the least, are understood to have the same meaning as, "about."

As used herein, "low frequency" means a frequency in the range from about 3 to about 300 Hertz (Hz).

Currently, ULM polyester toners result in a benchmark Minimum Fix Temperature (MFT) which is reduced by about 20° C. as compared to conventional EA toners. In embodiments, a ULM toner of the present disclosure may have an MFT of from about 100° C. to about 130° C., in embodiments, from about 105° C. to about 125° C., in embodiments, from about 110° C. to about 120° C.

As used herein, "acoustic intensity" means sound power, Pac, per unit area, where P=root mean square (RMS) sound pressure; a=particle acceleration; and c=speed of sound.

Resins

Any resin may be utilized in forming a latex emulsion of the present disclosure. In embodiments, the resins may be an amorphous resin, a crystalline resin or a combination thereof. In embodiments, the resin may be a polyester resin, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety. Suitable resins may include a mixture of high molecular and low molecular weight amorphous polyester resins.

In embodiments, the resin may be a polyester resin formed by reacting a diol with a diacid in the presence of an optional catalyst.

For forming a crystalline polyester, suitable organic diols include aliphatic diols with from about 2 to about 36 carbon atoms, such as, 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like including structural isomers thereof. The aliphatic diol may be, for example, selected in an amount of from about 40 to about 60 mole %, from about 42 to about 55 mole %, from about 45 to about 53 mole %, and an optional second diol can be selected in an amount of from about 0 to about 10 mole %, from about 1 to about 4 mole % of the resin.

Examples of diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The diacid may be selected in an amount of, for example, from about 40 to about 60 mole %, from about 42 to about 52 mole %, from about 45 to about 50 mole %, and an optional second diacid may be selected in an amount of from about 0 to about 10 mole % of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide) and poly(butylene-succinimide).

The crystalline resin may be present, for example, in an amount of from about 1 to about 50% by weight of the toner components, from about 5 to about 35% by weight of the toner components. The crystalline resin may possess various melting points of, for example, from about 30° C. to about 120° C., from about 50° C. to about 90° C. The crystalline resin may have a number average molecular weight (Mn), as measured by gel permeation chromatography (GPC) of, for example, from about 1,000 to about 50,000, from about 2,000 to about 25,000, and a weight average molecular weight (Mw) of, for example, from about 2,000 to about 100,000, from about 3,000 to about 80,000, as determined by GPC. The molecular weight distribution (Mw/Mn) of the crystalline resin may be, for example, from about 2 to about 6, from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate and combinations thereof. The diacids or diesters may be present, for example, in an amount from about 40 to about 60 mole % of the resin, from about 42 to about 52 mole % of the resin, from about 45 to about 50 mole % of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene and combinations thereof. The amount of diol(s) selected can vary, and may be present, for example, in an amount from about 40 to about 60 mole % of the resin, from about 42 to about 55 mole % of the resin, from about 45 to about 53 mole % of the resin.

Polycondensation catalysts which may be utilized in forming either the crystalline or amorphous polyesters include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide or combinations thereof. Such catalysts may be utilized in amounts of, for example, from about 0.01 mole % to about 5 mole % based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly (co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly (co-propoxylated bisphenol co-ethoxylated bisphenol co-itaconate), poly(1,2-propylene itaconate) and combinations thereof.

Suitable crystalline resins which may be utilized, optionally in combination with an amorphous resin as described above, include those disclosed in U.S. Pub. No. 2006/0222991, the disclosure of which is hereby incorporated by reference in entirety. In embodiments, a suitable crystalline resin may include a resin formed of ethylene glycol and a mixture of dodecanedioic acid and fumaric acid comonomers.

The amorphous resin may be present, for example, in an amount of from about 30 to about 100% by weight of the toner components, from about 40 to about 95% by weight of the toner components. In embodiments, the amorphous resin or combination of amorphous resins utilized in the latex may have a glass transition temperature (Tg) of from about 30° C. to about 80° C., from about 35° C. to about 70° C. In embodiments, the combined resins utilized in the latex may have a melt viscosity of from about 10 to about 1,000,000 Pa*S at about 130° C., from about 50 to about 100,000 Pa*S.

One, two or more resins may be used. In embodiments, where two or more resins are used, the resins may be in any suitable ratio (e.g., weight ratio) such as for instance of from about 1% (first resin)/99% (second resin) to about 99% (first resin)/1% (second resin), from about 10% (first resin)/90% (second resin) to about 90% (first resin)/10% (second resin).

In embodiments, a suitable toner of the present disclosure may include two amorphous polyester resins and a crystalline polyester resin. The weight ratio of the three resins may be from about 30% first amorphous resin/65% second amorphous resin/5% crystalline resin, to about 60% first amorphous resin/20% second amorphous resin/20% crystalline resin.

In embodiments, a suitable toner of the present disclosure may include at least two amorphous polyester resins, a high molecular weight (HMW) resin and a low molecular weight (LMW) resin. As used herein, an HMW amorphous resin may have an Mw of from about 35,000 to about 150,000, from about 45,000 to about 140,000, and an LMW amorphous resin may have an Mw of from about 10,000 to about 30,000, from about 15,000 to about 25,000.

The weight ratio of the two resins may be from about 10% first amorphous resin/90% second amorphous resin, to about 90% first amorphous resin/10% second amorphous resin.

In embodiments, the resin may possess acid groups which, in embodiments, may be present at the terminal of the resin. Acid groups which may be present include carboxylic acid groups and the like. The number of carboxylic acid groups may be controlled by adjusting the materials utilized to form the resin and reaction conditions.

In embodiments, the resin may be a polyester resin having an acid number from about 2 mg KOH/g of resin to about 200 mg KOH/g of resin, from about 5 mg KOH/g of resin to about 50 mg KOH/g of resin, from about 10 mg KOH/g of resin to about 15 mg KOH/g of resin. The acid containing resin may be dissolved in a tetrahydrofuran solution.

Solvent

Any suitable organic solvent may be used to dissolve the resin, for example, alcohols, esters, ethers, ketones, amines and combinations thereof, in an amount of, for example, from about 30% by weight to about 400% by weight of the resin, from about 40% by weight to about 250% by weight of the resin, from about 50% by weight to about 100% by weight of the resin. The ratio of resin to solvent on a weight basis can be from about 10:3 to about 10:15, from about 10:4 to about 10:13, from about 10:5 to about 10:12. Plural solvents can be used.

In embodiments, suitable organic solvents, sometimes referred to herein, in embodiments, as phase inversion agents, include, for example, methanol, ethanol, propanol, isopropyl alcohol (IPA), butanol, ethyl acetate, methyl ethyl ketone (MEK) and combinations thereof. In embodiments, the organic solvent may be immiscible in water and may have a boiling point of from about 30° C. to about 120° C. A combination of IPA and MEK can be used, for example, in a ratio, by weight, from about 10:1 to about 1:10, from about 5:1 to about 1:5.

Neutralizing Agent

In embodiments, the resin may be mixed with a weak base or neutralizing agent. In embodiments, the neutralizing agent may be used to neutralize acid groups in the resins, so a neutralizing agent herein may also be referred to as a, "basic neutralization agent." Any suitable basic neutralization reagent may be used in accordance with the present disclosure. In embodiments, suitable basic neutralization agents may include both inorganic basic agents and organic basic agents. Suitable basic agents may include ammonium hydroxide, potassium hydroxide, sodium hydroxide, sodium carbonate, sodium bicarbonate, lithium hydroxide, potassium carbonate, combinations thereof and the like. Suitable basic agents may also include monocyclic compounds and polycyclic compounds having at least one nitrogen atom, such as, for example, secondary amines, which include, aziridines, azetidines, piperazines, piperidines, pyridines, bipyridines, terpyridines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines and combinations thereof. In embodiments, the monocyclic and polycyclic compounds may be unsubstituted or substituted at any carbon position on the ring.

In embodiments, an emulsion formed in accordance with the present disclosure may also include a small quantity of water, in embodiments, deionized water (DIW), in amounts of from about 30% to about 95%, from about 30% to about 60%, at temperatures that melt or soften the resin, of from about 25° C. to about 120° C., from about 35° C. to about 80° C.

The basic agent may be utilized in an amount of from about 0.001% by weight to 50% by weight of the resin, from about 0.01% by weight to about 25% by weight of the resin, from about 0.1% by weight to 5% by weight of the resin. In embodiments, the neutralizing agent may be added in the form of an aqueous solution. In embodiments, the neutralizing agent may be added in the form of a solid.

Utilizing the above basic neutralization agent in combination with a resin possessing acid groups, a neutralization ratio of from about 25% to about 300% may be achieved, from about 50% to about 200%. In embodiments, the neutralization ratio may be calculated as the molar ratio of basic groups provided with the basic neutralizing agent to the acid groups present in the resin multiplied by 100%.

As noted above, the basic neutralization agent may be added to a resin possessing acid groups. The addition of the basic neutralization agent may thus raise the pH of an emulsion including a resin possessing acid groups from about 5 to about 12, from about 6 to about 11. The neutralization of the acid groups may, in embodiments, enhance formation of the emulsion.

Surfactants

In embodiments, the process of the present disclosure may optionally include adding a surfactant, before or during mixing, to the resin, colorant, wax and so on, at an elevated temperature. In embodiments, the surfactant may be added prior to mixing the resin at an elevated temperature.

Where utilized, a resin emulsion may include one, two or more surfactants. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration of from about 5% to about 100% (pure surfactant) by weight, from about 10% to about 95% by weight. In embodiments, the surfactant may be utilized so that it is present in an amount of from about 0.01% to about 20% by weight of the resin, from about 0.1% to about 16% by weight of the resin, from about 1% to about 14% by weight of the resin.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids, such as, abietic acid available from Aldrich, NEOGEN®, NEOGEN™ obtained from Daiichi Kogyo Seiyaku, combinations thereof and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of those surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$,$C_{15}$,$C_{17}$-trimethyl ammonium bromides, halide salts of quaternized polyoxyethylalkylamines, dodecylbenzyl triethyl ammonium chloride, MIRAPOL™ and ALKAQUATT™, available from Alkaril Chemical Company, SANIZOL™ (benzalkonium chloride), available from Kao Chemicals, and the like and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenc as IGEPAL CA210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments, SYNPERONIC PE/F 108. Combinations of those surfactants and any of the foregoing surfactants may be utilized in embodiments.

Processing

As noted above, the present process includes acoustic energy mixing to produce a latex emulsion. Suitable acoustic mixers are within the purview of those skilled in the art. In embodiments, an acoustic mixer may include a closed vessel without impellers, which uses low frequency, high intensity acoustic energy to provide the desired mixing.

Issues that may arise with the use of conventional mixers that possess impellers include, but are not limited to, a moderate mixing cycle; limited high viscosity mixing capability; viscous heating; limited filler loading capability; high shear localized mixing: requires contact mixing and impeller cleaning is an additional step that must be utilized in the process; and the process includes mixing and transferring to a container.

To the contrary, advantages to be found by using an acoustic mixer include, but are not limited to, fast mixing cycle; excellent high viscosity mixing capability; low heat generation; high rate of filler loading; high intensity mixing throughout the volume of material to be mixed; non contact, hygienic, sealed mixing; and a shorter process, as mixing may occur in the container possessing the material.

The selected acoustic mixer in accordance with the present disclosure provides intimate mixing by applying a consistent shear field throughout the entire vessel, and thus is suitable for the mixing amorphous latex resins.

In embodiments, a suitable acoustic mixer for use in accordance with the present disclosure includes LABRAM mixers and RESONANT ACOUSTIC® mixers, without impellers, commercially available from Resodyn Acoustic Mixers, Inc. (Butte, Mont.). The acoustic mixer is operated on a resonant frequency. A closely controlled electromechanical oscillator is used to excite the mix material. The acoustic mixer may operate at a frequency of from about 3 Hz to about 300 Hz, from about 30 Hz to about 100 Hz, from about 60 Hz to about 65 Hz. The entire system may oscillate in resonance, allowing highly efficient energy transfer and rapid mixing of the components of the latex emulsion.

Thus, in embodiments, the process of making the latex emulsion may include mixing one or more latex resins, a base, one or more solvents and water in a vessel; subjecting the mixture to acoustic mixing at a frequency of from about 3 Hertz to about 300 Hertz; forming a uniform latex resin emulsion, wherein particles comprising said emulsion have a particle size from about 100 nm to about less than 500 nm, less that about 200 nm, less than about 120 nm, less than about 100 nm. In embodiments, the acceleration may be from about 1 to about 120 g, from about 50 to about 110 g, from about 80 to about 100 g. In embodiments, the intensity may be from about 10 to about 100%, from about 15% to about 95%, from about 50 to about 95%, from about 20% to about 90%, from about 80 to about 90%.

In embodiments, the acoustic mixing can be carried out for less than about 30 minutes, from about 05 minutes to about 30 minutes, from about 10 to about 20 minutes.

The latex emulsions of the present disclosure may then be utilized to produce particles that are suitable for emulsion aggregation ultra low melt toner, for example, using a combination of crystalline and amorphous polyester resins. The smaller particles can be used for hyperpigmented toner.

Toner

Once the resin mixture has been contacted with water to form an emulsion and the solvent removed from the mixture, the resulting latex may then be utilized to form a Loner by any method within the purview of those skilled in the art. The latex emulsion may be contacted with a colorant, optionally in a dispersion, and other additives to form a toner by a suitable process, in embodiments, an emulsion aggregation and coalescence process.

In embodiments, the optional additional ingredients of a toner composition including colorant, wax and other additives, may be added before, during or after mixing the resin to form the latex emulsion of the present disclosure. The additional ingredients may be added before, during or after formation of the latex emulsion. In embodiments, the colorant may be added before the addition of the surfactant.

Colorants

Various known suitable colorants, such as dyes, pigments, mixtures of dyes, mixtures of pigments, mixtures of dyes and pigments and the like, may be included in the toner. In embodiments, the colorant may be included in the toner in an amount of, for example, about 0.1 to about 35% by weight of the toner, from about 1 to about 25% by weight of the toner, from about 3 to about 15% by weight of the toner, although the amount of colorant can be outside of those ranges, for example, at least about 6.5%, at least about 7%, at least about 7.5%, at least about 8%.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water-based pigment dispersions.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing and the like.

Other suitable water-based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof and the like, as water-based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™ and the like. Generally, colorants that can be selected are black, cyan, magenta, yellow and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19 and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3 and Anthrathrene Blue, identified in the Color Index as CI-69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1% by weight to about 25% by weight of the toner particles, from about 5% by weight to about 20% by weight of the toner particles, although the amount of wax can be outside of those ranges.

When a wax dispersion is used, the wax dispersion may include any of the various waxes conventionally used in emulsion aggregation toner compositions. Waxes that may be selected include waxes having, for example, an average molecular weight of from about 500 to about 20,000, in embodiments, from about 1,000 to about 10,000. Waxes that may be used include, for example, polyolefins, such as, polyethylene, including, linear polyethylene waxes and branched polyethylene waxes, polypropylene including linear polypropylene waxes and branched polypropylene waxes, polyethylene/amide, polyethylenetetrafluoroethylene, polyethylene-tetrafluoroethylene/amide, and polybutene waxes, such as, commercially available from Allied Chemical and Petrolite Corporation, for example POLYWAX™ polyethylene waxes, such as, commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax, such as, waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as, butyl stearate, propyl oleate, glyceride monostearate, glyceride distearate and pentaerythritol tetra behenate, ester waxes obtained from higher fatty acid and multivalent alcohol multimers, such as, diethylene glycol monostearate, dipropylene glycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™, SUPERSLIP 6530™ available from Micro Powder Inc., fluorinated waxes, for example, POLYFLUO 190™, POLYFLUO 200™, POLYSILK 19™, POLYSILK 14™ available from Micro Powder Inc. mixed fluorinated, amide waxes, such as, aliphatic polar amide-functionalized waxes; aliphatic waxes consisting of esters of hydroxylated unsaturated fatty acids, for example, MICROSPERSION 19™ available from Micro Powder Inc., imides, esters, quaternary amines, carboxylic acids or acrylic polymer emulsion, for example, JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 500 nm.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which small-sized resin particles are aggregated to the appropriate toner particle size and then coalesced to achieve the final toner particle size and morphology.

In embodiments, toner compositions may be prepared by emulsion aggregation processes, such as, a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized by mixing at about 600 to about 6,000 revolutions per minute (rpm). Homogenization may be accomplished by any suitable means, including, for example, an IKA ULTRA TURRAX T50 probe homogenizer.

Following preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent, such as, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate and combinations thereof. In embodiments, the aggregating agent may be added to the mixture at a temperature that is below the Tg of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$,$C_{15}$,$C_{17}$-trimethyl ammonium bromides, halide salts of quaternized polyoxyethylalkylamines, dodecylbenzyl triethyl ammonium chloride, combinations thereof and the like.

Other suitable aggregating agents also include, but are not limited to, tetraalkyl titmates, dialkyltin oxide, tetraalkyltin oxide hydroxide, dialkyltin oxide hydroxide, aluminum alkoxides, alkyl zinc, dialkyl zinc, zinc oxides, stannous oxide, dibutyltin oxide, dibutyltin oxide hydroxide, tetraalkyl tin, combinations thereof and the like. Where the aggregating agent is a polyion aggregating agent, the agent may have any desired number of polyion atoms present. For example, in embodiments, suitable polyaluminum compounds have from about 2 to about 13, from about 3 to about 8, aluminum ions present in the compound.

The aggregating agent may be added to the mixture utilized to form a toner in an amount of, for example, from about 0.1% to about 10% by weight, from about 0.2% to about 8% by weight, from about 0.5% to about 5% by weight, of the resin in the mixture.

The particles may be permitted to aggregate until a predetermined desired particle size is obtained. Samples may be taken during the growth process and analyzed, for example, with a COULTER COUNTER, for average particle size. The aggregation thus may proceed by maintaining the elevated temperature, or slowly raising the temperature to for example, from about 40° C. to about 100° C., and holding the mixture at that temperature for a time of from about 0.5 hours to about 6 hours, from about an hour to about 5 hours, while maintaining stirring, to provide the aggregated particles. Once the predetermined desired particle size is reached, then the shell resin emulsion is added.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example, of from about 40° C. to about 90° C. from about 45° C. to about 80° C., which may be below the Tg of the resin as discussed above.

Shell Resin

In embodiments, after aggregation, but prior to coalescence, a resin coating may be applied to the aggregated particles to form a shell thereover. In embodiments, the core may thus include an amorphous resin and/or a crystalline resin, as described above. Any resin described above may be utilized as the shell. In embodiments, a polyester amorphous resin latex as described above may be included in the shell. In embodiments, the polyester amorphous resin latex described above may be combined with a different resin, and then added to the particles as a resin coating to form a shell.

In embodiments, resins which may be utilized to form a shell include, but are not limited to, a crystalline resin latex described above, and/or the amorphous resins described above. In embodiments, an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin may be present in an amount of from about 20% by weight to about 100% by weight of the total shell resin, from about 30% by weight to about 90% by weight of the total shell resin. Thus, in embodiments, a second resin may be present in an amount of from about 0% by weight to about 80% by weight of the total shell resin, from about 10% by weight to about 70% by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the solvent based amorphous polyester resin latex neutralized with base, such as, NaOH, described above, may be combined with the aggregated particles described above so that the shell forms over the aggregated particles.

The formation of the shell over the aggregated particles may occur while heating to a temperature of from about 30° C. to about 80° C., from about 35° C. to about 70° C. Formation of the shell may take place for a period of from about 5 minutes to about 10 hours, from about 10 minutes to about 5 hours.

The shell may be present in an amount of from about 10% by weight to about 40% by weight of the latex particles, from about 20% by weight to about 35% by weight of the latex particles.

Once the desired final size of the toner particles is achieved, the pH of the mixture may be adjusted with a base to a value of from about 3 to about 10, from about 5 to about 9. Adjustment of the pH may be utilized to freeze, that is to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, a chelator, such as, ethylene diamine tetraacetic acid (EDTA), may be added to help adjust the pH to the desired values noted above.

In embodiments, the final size of the toner particles may be of from about 2 μm to about 12 μm, from about 3 μm to about 10 μm.

Coalescence

Following aggregation to the desired particle size and application of any optional shell, the particles may then be coalesced to the desired final shape, the coalescence being achieved by, for example, heating the mixture to a temperature of from about 45° C. to about 100° C., from about 55° C. to about 99° C., which may be at or above the Tg of the resin(s) utilized to form the toner particles. Coalescence may be accomplished over a period of from about 0.01 to about 9 hours, from about 0.1 to about 4 hours.

After aggregation and/or coalescence, the mixture may be cooled to room temperature, such as, from about 20° C. to about 25° C. The cooling may be rapid or slow, as desired. A suitable cooling method may include introducing cold water to a jacket around the reactor. After cooling, the toner particles may be optionally washed with water and then dried. Drying may be by any suitable method for drying including, for example, freeze drying.

Additives

In embodiments, the toner particles may also contain other optional additives, as desired or required. For example, the toner may include positive or negative charge control agents, for example, in an amount of from about 0.1 to about 10% by weight of the toner, from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in entirety; organic sulfate and sulfonate compositions, including those disclosed in U.S. Pat. No. 4,338,390, the disclosure of which is hereby incorporated by reference in entirety; cetyl pyridinium tetrafluoroborates; distearyl dimethyl ammonium methyl sulfate; aluminum salts, such as, BONTRON E84™ or E88™ (Orient Chemical Industries. Ltd.); combinations thereof and the like.

There can also be blended with the toner particles external additive particles after formation including flow aid additives, which additives may be present on the surface of the toner particles. Examples of the additives include metal oxides, such as, titanium oxide, silicon oxide, aluminum oxides, cerium oxides, tin oxide, mixtures thereof and the like; colloidal and amorphous silicas, such as, AEROSIL®, metal salts and metal salts of fatty acids inclusive of zinc stearate and calcium stearate, long chain alcohols, such as, UNILIN 700, and mixtures thereof.

In general, silica may be applied to the toner surface for toner flow, tribo enhancement, admix control, improved development and transfer stability and higher toner blocking temperature. $TiO_2$ may be applied for improved relative humidity (RH) stability, tribo control and improved development and transfer stability. Zinc stearate, calcium stearate and/or magnesium stearate optionally may be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of the external additives may be present in an amount of from about 0.1% by weight to about 5% by weight of the toner, from about 0.25% by weight to about 3% by weight of the toner, although the amount of additives can be outside of those ranges. In embodiments, the toners may include, for example, from about 0.1% by weight to about 5% by weight titania, from about 0.1% by weight to about 8% by weight silica and from about 0.1% by weight to about 4% by weight zinc stearate.

Suitable additives include those disclosed in U.S. Pat. Nos. 3,590,000, 3,800,588, and 6,214,507, the disclosure of each of which hereby is incorporated by reference in entirety.

In embodiments, toners of the present disclosure may be utilized as ULM or hyperpigmented toners. In embodiments, the dry toner particles having a shell of the present disclosure may, exclusive of external surface additives, have the following characteristics:

(1) volume average diameter (also referred to as "volume average particle diameter") of from about 3 to about 25 μm, from about 4 to about 15 μm, from about 5 to about 12 μm;

(2) Number Average Geometric Size Distribution (GSDn) and/or Volume Average Geometric Size Distribution (GSDv) of from about 1.05 to about 1.55, from about 1.1 to about 1.4; and (3) circularity of from about 0.93 to about 1, from about 0.95 to about 0.99 (as measured with, for example, a Sysmex FPIA 2100 analyzer).

The characteristics of the toner particles may be determined by any suitable technique and apparatus. Volume average particle diameter, D50 v, GSDv and GSDn may be measured by means of a measuring instrument, such as, a Beckman Coulter MULTISIZER 3.

The subject matter of interest now will be exemplified in the following non-limiting examples. Parts and percentages are by weight unless otherwise indicated. As used herein, "room temperature," (RT) refers to a temperature of from about 20° C. to about 30° C.

EXAMPLES

Example

LMW Amorphous Polyester Prepared by Resodyn Acoustic Mixer

Thirty grams of amorphous polyester resin, 15 grams of MEK and 3 grams of IPA were added to a 125 ml plastic container (the ratio of resin to MEK to IPA was 10:5:1). The plastic container was then sealed and placed in the Resodyn LabRAM device for 10 minutes at room temperature at 100% intensity, 61.8 Hz and 108 g. Then, 0.94 grams of 10% ammonium hydroxide solution were added to the above mixture and placed in the RAM device for 30 seconds under the same conditions. The 30 grams of DIW were added to plastic container which was placed in the RAM device for 3 minutes. Another 30 grams of DIW were added and the contents mixed for 2 minutes. The emulsion produced had a particle size of 118 nm as measured using a Nanotrac particle size analyzer.

The experimental toner was compared to a conventional toner produced in a stirred reactor using the same reagents in the amounts noted in Table 1 below. The process conditions also are provided in Table 1.

TABLE 1

Comparison of two processes/formulations (Stirred reactor vs. RAM)

| | Stirred Reactor | RAM Mixer |
|---|---|---|
| PIE Process Comparison | | |
| Temperature (° C.) | 40 | 22 |
| Ramp-up time (min) | ~120 | N/A |
| Dissolution time (min) | ~120 | 10 |
| Neutralization time (min) | 12 | 0.5 |
| Emulsification (min) | 60 | 5 |
| Total processing time (min) | 312 | 15.5 |
| PIE Formulation Comparison | | |
| LWM Resin (part) | 10 | 10 |
| MEK (part) | 5 | 5 |
| IPA (part) | 1 | 1 |
| 10% $NH_4OH$ (part) | 0.32 | 0.32 |
| Latex particle size (nm) | 190-220 | 118 |

As noted, the subject matter of interest enables processing just at about room temperature with the reaction occurring in a very short period of time. The particles of the subject matter of interest are nearly half the size of the resin particles produced in a batch reactor.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. A process comprising:

a) combining a first amorphous resin, a solvent, an optional base and water to form a mixture;

b) subjecting the mixture to acoustic mixing at a frequency of from about 3 Hertz to about 300 Hertz at room temperature; and c) recovering a resin emulsion.

2. The process according to claim 1, wherein the first amorphous resin and said solvent are combined and are subjected to acoustic mixing, followed by adding said base and repeating the subjecting step.

3. The process according to claim 2, further comprising adding water in two or more portions, with intermittent acoustic mixing after each water addition.

4. The process according to claim 1, wherein the final particle size of the latex resin is less than about 500 nm.

5. The process according to claim 1, wherein said first amorphous resin is a high molecular weight resin or a low molecular weight resin.

6. The process according to claim 1, wherein said first amorphous resin is selected from the group consisting of the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

7. The process according to claim 1, wherein said solvent is selected from the group consisting of methanol, ethanol, isopropanol, butanol, ethylene glycol, glycerol, sorbitol, acetone, 2-butanone, 2-pentanone, 3-pentanone, ethyl isopropyl ketone, methyl isobutyl ketone, diisobutyl ketone, methyl ethyl ketone, dmethylformamide, dimethylacetamide, N-methylpyrrolidone, 1,2-dimethyl-2-imidazolidinone, acetonitrile, propionitrile, butyronitrile, isobutyronitrile, valeronitrile, benzonitrile, ditertbutyl ether, dimethoxyethane, 2-methoxyethyl ether, 1,4-dioxane, tetrahydrohyran, morpholine, methylsulfonylmethane, sulfolane, dimethylsulfoxide, hexamethylphosphoramide, benzenes esters, and amines.

8. The process according to claim 1, wherein said solvent comprises methyl ethyl ketone (MEK) and isopropyl alcohol (IPA).

9. The process according to claim 8, wherein the resin to MEK to IPA ratio is about 10:5:1 (wt:wt:wt).

10. The process according to claim 1, wherein said resin and said solvent are present in a ratio from about 10:5 to about 10:12.

11. The process according to claim 1, wherein said mixing is carried out in an acoustic mixer at about 1 to about 120 g.

12. The process according to claim 1, wherein said base is selected from the group consisting of ammonium hydroxide, potassium hydroxide, sodium hydroxide, sodium carbonate, sodium bicarbonate, lithium hydroxide, potassium carbonate, potassium bicarbonate, secondary amines, which include aziridines, azetidines, piperazines, piperidines, pyridines, bipyridines, terpyridines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines, and combinations thereof.

13. The process according to claim 1, further comprising:

d) combining said resin emulsion with an optional second amorphous resin, an optional crystalline resin emulsion, an optional wax and an optional colorant;

e) optionally adding a flocculent to the emulsion;

f) aggregating particles in said emulsion;

g) optionally adding a shell resin;

h) optionally freezing particle growth in said emulsion; and i) optionally coalescing said particles to yield toner particles.

14. The method of claim 13, wherein said emulsion comprises a second amorphous resin.

15. The method of claim 14, wherein the first amorphous resin is a low molecular weight resin and the second amorphous resin is a high molecular weight resin.

16. The method of claim 13, wherein said colorant is present in an amount at least about 6.5% of said toner.

17. The method of claim 13, further comprising a crystalline resin.

18. The method of claim 13, comprising adding a shell resin.

19. The method of claim 13, wherein said freezing comprising raising pH of said emulsion, adding a chelator to said emulsion or both.

20. The method of claim 13, further comprising a wax.

* * * * *